US011215398B2

(12) United States Patent
Matsuda et al.

(10) Patent No.: US 11,215,398 B2
(45) Date of Patent: Jan. 4, 2022

(54) WEB DRYING APPARATUS

(71) Applicant: SCREEN HOLDINGS CO., LTD., Kyoto (JP)

(72) Inventors: Takeshi Matsuda, Kyoto (JP); Yoshikuni Takeichi, Kyoto (JP); Kenta Hiramatsu, Kyoto (JP); Keisuke Hirai, Kyoto (JP); Ryota Uemura, Kyoto (JP)

(73) Assignee: SCREEN HOLDINGS, CO., LTD., Kyoto (JP)

( * ) Notice: Subject to any disclaimer, the term of this patent is extended or adjusted under 35 U.S.C. 154(b) by 146 days.

(21) Appl. No.: 16/805,338

(22) Filed: Feb. 28, 2020

(65) Prior Publication Data

US 2020/0300543 A1 Sep. 24, 2020

(30) Foreign Application Priority Data

Mar. 22, 2019 (JP) ..... JP2019-054120

(51) Int. Cl.
*F26B 13/06* (2006.01)
*F26B 13/10* (2006.01)
*F26B 13/14* (2006.01)

(52) U.S. Cl.
CPC ..... *F26B 13/108* (2013.01); *F26B 13/14* (2013.01)

(58) Field of Classification Search
CPC .... F26B 13/005; F26B 13/006; F26B 13/108; F26B 13/14; F26B 13/10; F26B 13/28; F26B 13/06; F26B 21/004; F26B 25/0614; F26B 13/104; B65H 20/10
USPC ..... 34/643, 637, 612, 621, 629, 636, 638, 34/640, 641, 647, 657, 662
See application file for complete search history.

(56) References Cited

U.S. PATENT DOCUMENTS 4,425,719 A * 1/1984 Klein ..... B65H 23/24 34/644
5,134,788 A * 8/1992 Stibbe ..... F26B 13/104 34/524
5,749,164 A * 5/1998 Bowden ..... F26B 13/104 34/641

(Continued)

FOREIGN PATENT DOCUMENTS

JP 2012-149788 A 8/2012
KR 10-2007-0115089 A 12/2007
KR 10-2010-0062743 A 6/2010

OTHER PUBLICATIONS

Extended European Search Report issued in corresponding European Patent Application No. 20159101.3-1009, dated Oct. 6, 2020.

(Continued)

*Primary Examiner* — John P McCormack
(74) *Attorney, Agent, or Firm* — McDermott Will & Emery LLP

(57) ABSTRACT

A web drying apparatus, comprises: two blower units which are arranged vertically between an upper dry path and a lower dry path disposed below the upper dry path and at least partially overlap each other when viewed from a vertical direction. One blower unit disposed on an upper side, the other blower unit disposed on a lower side. The lower end part of the one blower unit deviates from the upper end part of the other blower unit in the horizontal direction and protrudes to be lower than the upper end part in the vertical direction.

6 Claims, 7 Drawing Sheets

(56) References Cited

U.S. PATENT DOCUMENTS

| | | | | |
|---|---|---|---|---|
| 6,230,422 | B1 * | 5/2001 | Sairanen | D21F 5/185<br>162/207 |
| 2004/0064967 | A1 | 4/2004 | Birgersson et al. | |
| 2004/0181967 | A1 | 9/2004 | Fujinami et al. | |
| 2013/0255096 | A1 * | 10/2013 | Kampris | D21F 7/04<br>34/85 |

OTHER PUBLICATIONS

Korean Notice of Allowance issued in corresponding Korean Patent Application No. 10-2020-0003200, dated Jun. 10, 2021, with English translation.

* cited by examiner

F I G. 7

| | Xla (Xra) | Xlc (Xrc) | Xlb (Xrb) |
|---|---|---|---|
| POSITIONAL RELATION R1 | Vl | | |
| | | Vu | |
| POSITIONAL RELATION R2 | Vl | | |
| | | | Vu |
| POSITIONAL RELATION R3 | | Vl | |
| | Vu | | |
| POSITIONAL RELATION R4 | | Vl | |
| | | | Vu |
| POSITIONAL RELATION R5 | | | Vl |
| | Vu | | |
| POSITIONAL RELATION R6 | | | Vl |
| | | Vu | |

WEB DRYING APPARATUS

CROSS REFERENCE TO RELATED APPLICATION

The disclosure of Japanese Patent Application No. 2019-054120 filed on Mar. 22, 2019 including specification, drawings and claims is incorporated herein by reference in its entirety.

BACKGROUND OF THE INVENTION

1. Field of the Invention

The present invention relates to a technology for drying web by injecting gas onto the web.

2. Description of the Related Art

Japanese Patent Application Laid Open Gazette No. 2012-149788 discloses an apparatus for drying web by injecting gas onto the web passing through a dry path. In this apparatus, particularly, two dry paths are vertically provided, and for each of these dry paths, disposed is a mechanism for injecting the gas.

SUMMARY OF THE INVENTION

For a drying apparatus in which two dry paths are vertically provided as above, a configuration can be considered, in which two blower units each injecting gas onto web which passes through the dry path are vertically disposed between these two dry paths. It thereby becomes possible to perform an operation to inject gas to an upper dry path from an upper blower unit and inject gas to a lower dry path from a lower blower unit. Since the two blower units are vertically arranged, however, there arises a problem that a placement space therefor becomes larger.

The present invention is intended to solve the above problem, and it is an object of the present invention to compactly arrange two blower units vertically between two dry paths in a drying apparatus which injects gas to web passing through the dry paths from the blower units.

A web drying apparatus according to the invention, comprises: two blower units which are arranged vertically between an upper dry path and a lower dry path disposed below the upper dry path and at least partially overlap each other when viewed from a vertical direction, wherein one blower unit disposed on an upper side, among the two blower units, faces the upper dry path from downward and injects gas onto web passing through the upper dry path, the other blower unit disposed on a lower side, among the two blower units, faces the lower dry path from upward and injects gas onto web passing through the lower dry path, the one blower unit has a first sidewall provided at one end in a horizontal direction, a second sidewall provided at the other end in the horizontal direction, and a lower end part which is disposed between the first sidewall and the second sidewall, the lower end part is positioned lower than the first sidewall and the second sidewall and forms a lower end of the one blower unit, the other blower unit has a third sidewall provided at one end in the horizontal direction, a fourth sidewall provided at the other end in the horizontal direction, and an upper end part which is disposed between the third sidewall and the fourth sidewall, the upper end part is positioned upper than the third sidewall and the fourth sidewall and forms an upper end of the other blower unit, and the lower end part of the one blower unit deviates from the upper end part of the other blower unit in the horizontal direction and protrudes to be lower than the upper end part in the vertical direction.

In the present invention (the web drying apparatus) having such a configuration, the two blower units are so arranged vertically between the upper dry path and the lower dry path as to at least partially overlap each other when viewed from the vertical direction.

Particularly, the two blower units are arranged so that the lower end part of the one blower unit which is an upper one of the two blower units deviates from the upper end part of the other blower unit which is a lower one of the two blower units in the horizontal direction and protrude to be lower than the upper end part in the vertical direction. Thus, it becomes possible to compactly arrange the two blower units vertically between the two dry paths.

Thus, according to the present invention, it is possible to compactly arrange two blower units vertically between two dry paths.

The above and further objects and novel features of the invention will more fully appear from the following detailed description when the same is read in connection with the accompanying drawing. It is to be expressly understood, however, that the drawing is for purpose of illustration only and is not intended as a definition of the limits of the invention.

BRIEF DESCRIPTION OF THE DRAWINGS

FIG. 7 is a view showing a variation of the positional relation between the protruding parts in a tabular form.

DETAILED DESCRIPTION OF THE PREFERRED EMBODIMENTS

Figure 1:
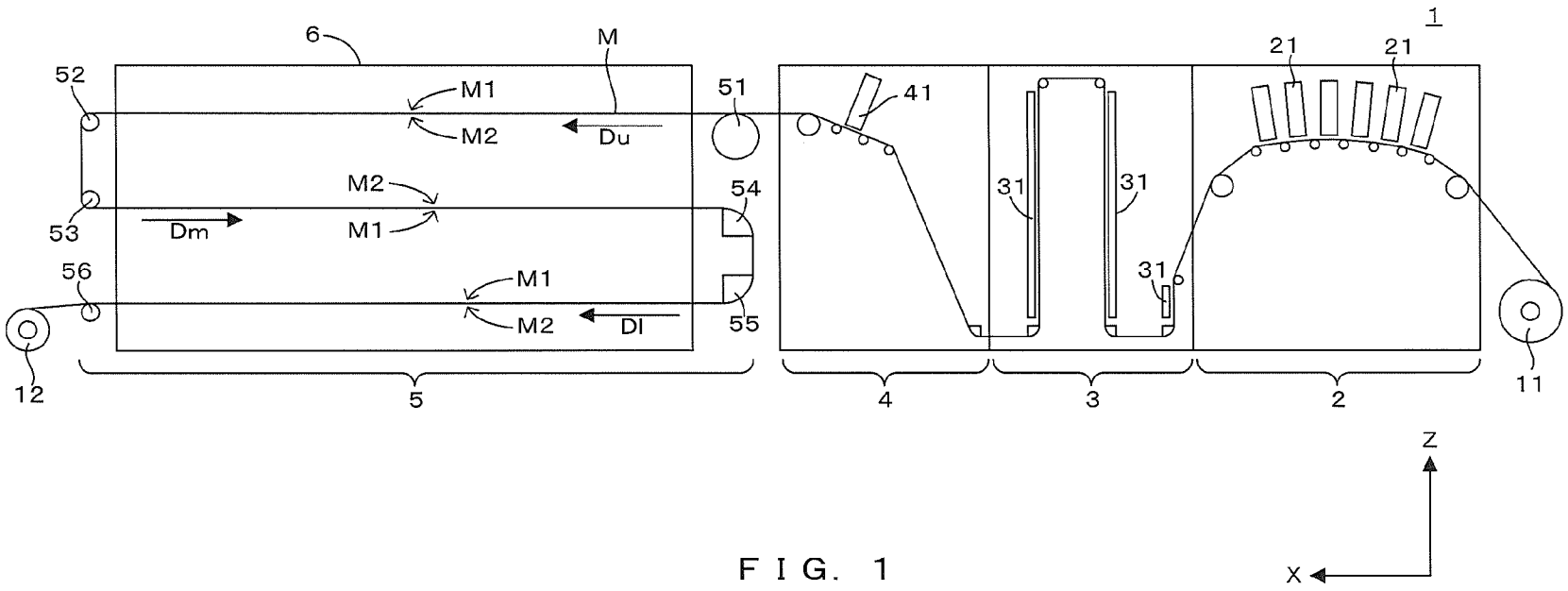
FIG. 1 is an elevational view schematically showing one example of a printing system including a drying furnace which corresponds to one example of a web drying apparatus in accordance with the present invention.

FIG. 1 is an elevational view schematically showing one example of a printing system including a drying furnace which corresponds to one example of a web drying apparatus in accordance with the present invention. In FIG. 1 and the following figures, a horizontal direction X and a vertical direction Z are shown as appropriate. As shown in FIG. 1, a printing system 1 includes a configuration in which a prestage printer 2, a prestage drying furnace 3, a post-stage printer 4, and a post-stage drying furnace 5 which have the same height are arranged in this order in the horizontal direction X (arrangement direction). This printing system 1 transfers a printing medium M from a feed roll 11 to a wind-up roll 12 in a roll-to-roll process while causing the prestage drying furnace 3 to dry the printing medium M printed by the prestage printer 2 and further causing the post-stage drying furnace 5 to dry the printing medium M printed by the post-stage printer 4. Further, as the printing medium M, various materials such as paper, a film, or the like can be used. Furthermore, hereinafter, among both surfaces of the printing medium M, the surface on which an image is printed is referred to as a front surface M1 and the other surface opposite to the front surface M1 is referred to as a back surface M2 as appropriate.

The prestage printer 2 includes a plurality of print heads 21 which eject ink by the inkjet method onto the front surface M1 of the printing medium M. In the exemplary case shown herein, provided are six print heads 21 including four print heads 21 which eject inks of four process colors (yellow, magenta, cyan, and black) and two print heads 21 which eject inks of two special colors (orange, violet, green, or the like). Specifically, the prestage printer 2 can print a color image on the front surface M1 of the printing medium M by using the six print heads 21 which eject color inks of different colors from one another. Further, the print heads 21 which eject the special color inks are not indispensable.

The printing medium M on which the color image is printed by the prestage printer 2 is transferred from the prestage printer 2 to the prestage drying furnace 3. The prestage drying furnace 3 uses a heater 31 to heat the printing medium M while folding the printing medium M over in the vertical direction Z as appropriate. The ink adhered on the front surface M1 of the printing medium M is thereby dried. The means to dry the printing medium M in the prestage drying furnace 3 is not limited to the heater 31, but the printing medium M may be heated and dried by injecting hot air, or may be dried by injecting gas of room temperature.

Thus, the printing medium M dried by the prestage drying furnace 3 is transferred from the prestage drying furnace 3 to the post-stage printer 4. The post-stage printer 4 includes a print head 41 for ejecting ink by the inkjet method onto the front surface M1 of the printing medium M. In the exemplary case shown herein, the print head 41 ejects white ink. Therefore, the post-stage printer 4 can print a white background image on the front surface M1 of the printing medium M, to the color image printed by the prestage printer 2.

The printing medium M on which the background image is printed by the post-stage printer 4 is transferred from the post-stage printer 4 to the post-stage drying furnace 5. Then, the post-stage drying furnace 5 dries the inks forming the color image printed on the printing medium M by the prestage printer 2 and the ink forming the background image printed on the printing medium M by the post-stage printer 4.

Figure 2:
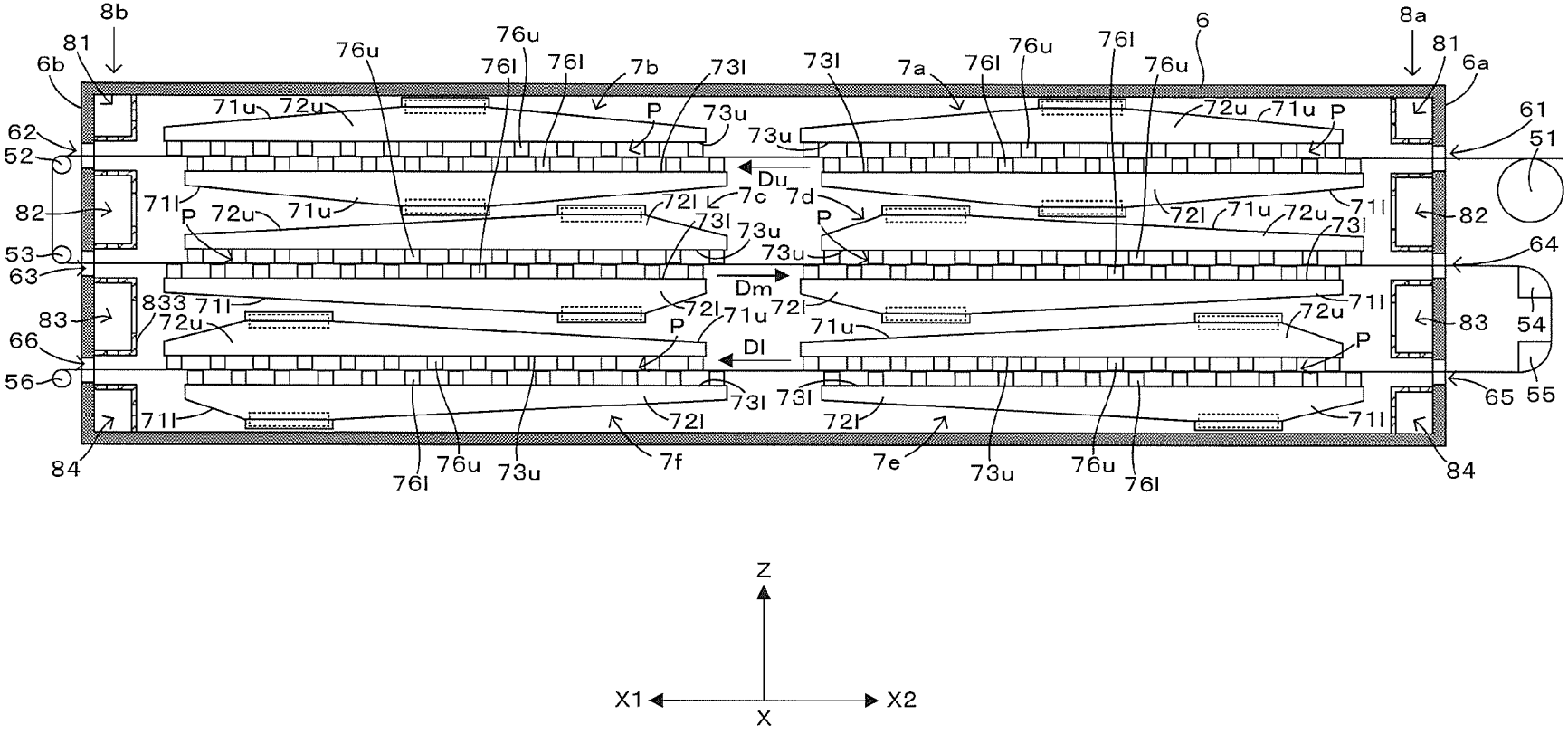
FIG. 2 is a partial cross section of an elevational view schematically showing the post-stage drying furnace included in the printing system of FIG. 1.

FIG. 2 is a partial cross section of an elevational view schematically showing the post-stage drying furnace included in the printing system of FIG. 1. In FIG. 2, one side of the horizontal direction X is represented as an "X1 side", and the other side of the horizontal direction X is represented as an "X2 side" (the opposite side to the X1 side). Further, also in the following figures, like representation will be used as appropriate.

The post-stage drying furnace 5 dries the printing medium M while folding the printing medium M over in the horizontal direction X as appropriate and transferring it. This post-stage drying furnace 5 includes a housing 6 disposed with an interval from the post-stage printer 4 in the horizontal direction X. This housing 6 has a rectangular parallelepiped shape extending in the horizontal direction X, and both sidewalls 6*a* and 6*b* of the housing 6 in the horizontal direction X are in parallel with the vertical direction Z and perpendicular to the horizontal direction X, facing each other with an interval in the horizontal direction X.

In the sidewall 6*a* on the X2 side (on the post-stage printer 4 side) in the horizontal direction X out of the sidewalls 6*a* and 6*b*, three openings 61, 64, and 65 aligned in the vertical direction Z penetrate in the horizontal direction X, and in the sidewall 6*b* on the X1 side (on the opposite side to the post-stage printer 4) in the horizontal direction X, three openings 62, 63, and 66 aligned in the vertical direction Z penetrate in the horizontal direction X. In the sidewall 6*a*, the opening 61 is provided upper than the opening 64, and the opening 64 is provided upper than the opening 65. In the sidewall 6*b*, the opening 62 is provided upper than the opening 63, and the opening 63 is provided upper than the opening 66. The openings 61 and 62 are positioned at the same height, facing each other in the horizontal direction X, the openings 63 and 64 are positioned at the same height, facing each other in the horizontal direction X, and the openings 65 and 66 are positioned at the same height, facing each other in the horizontal direction X. Then, the printing medium M passes through these openings 61 to 66 sequentially to move between the inside and the outside of the housing 6 while being transferred by the feed roll 11 and the wind-up roll 12.

The post-stage drying furnace 5 includes a roller 51 disposed outside the housing 6 with respect to the opening 61. The roller 51 is disposed on the X2 side to the housing 6 in the horizontal direction X (in other words, disposed between the post-stage printer 4 and the housing 6), and supports the printing medium M from the back surface M2 side by coming into contact with the back surface M2 (lower surface) of the printing medium M. Then, the printing medium M unloaded from the post-stage printer 4 is loaded into the housing 6 through the opening 61 of the sidewall 6*a* while being supported by the roller 51. Thus, the printing medium M passing through the sidewall 6*a* through the opening 61 is moved in an upper-stage transfer direction Du directed from the opening 61 to the opening 62 in parallel with the horizontal direction X and unloaded to the outside of the housing 6 from the opening 62 of the sidewall 6*b*.

The post-stage drying furnace 5 includes rollers 52 and 53 aligned vertically outside the housing 6 on the X1 side to the housing 6 in the horizontal direction X in order to fold the printing medium M over, which is unloaded from the opening 62. The upper roller 52 is disposed with respect to the opening 62 and folds the printing medium M downward in the vertical direction Z while supporting the printing medium M from the back surface M2 side by coming into contact with the back surface M2 of the printing medium M unloaded from the opening 62 toward the X1 side in the horizontal direction X. The lower roller 53 is disposed with respect to the opening 63 and folds the printing medium M toward the X2 side in the horizontal direction X while supporting the printing medium M from the back surface M2 side by coming into contact with the back surface M2 of the printing medium M moving downward from the roller 52. Further, by folding the printing medium M over as above, the front surface M1 and the back surface M2 of the printing medium M are reversed up and down.

Thus, the printing medium M folded over by the roller 53 is loaded into the housing 6 from the opening 63 of the sidewall 6*b*. The printing medium M passing through the sidewall 6*b* through the opening 63 is moved in a middle-stage transfer direction Dm directed from the opening 63 to the opening 64 in parallel with the horizontal direction X and unloaded to the outside of the housing 6 from the opening 64 of the sidewall 6*a*.

The post-stage drying furnace 5 includes air turn bars 54 and 55 aligned vertically outside the housing 6 on the X2 side to the housing 6 in the horizontal direction X in order to fold the printing medium M over, which is unloaded from the opening 64. The upper air turn bar 54 is disposed with respect to the opening 64 and injects air onto the printing medium M from the front surface M1 side of the printing medium M unloaded from the opening 64 toward the X2 side in the horizontal direction X. The air turn bar 54 thereby folds the printing medium M downward in the vertical direction Z while supporting the printing medium M from the front surface M1 side with a clearance from the printing medium M.

The lower air turn bar 55 is disposed with respect to the opening 65 and injects air onto the printing medium M from the front surface M1 side of the printing medium M moving downward from the air turn bar 54. The air turn bar 55 thereby folds the printing medium M toward the X1 side in the horizontal direction X while supporting the printing medium M from the front surface M1 side with a clearance from the printing medium M. Further, by folding the printing medium M over as above, the front surface M1 and the back surface M2 of the printing medium M are reversed up and down.

Thus, the printing medium M folded over by the air turn bar 55 is loaded into the housing 6 from the opening 65 of the sidewall 6*a*. The printing medium M passing through the sidewall 6*a* through the opening 65 is moved in a lower-stage transfer direction Dl directed from the opening 65 to the opening 66 in parallel with the horizontal direction X and unloaded to the outside of the housing 6 from the opening 66 of the sidewall 6*b*.

Further, the post-stage drying furnace 5 includes a roller 56 disposed outside the housing 6 on the X1 side to the housing 6 in the horizontal direction X in order to support the printing medium M which is unloaded from the opening 66. This roller 56 is disposed with respect to the opening 66 and supports the printing medium M from the back surface M2 side by coming into contact with the back surface M2 of the printing medium M unloaded from the opening 66 toward the X1 side in the horizontal direction X.

The post-stage drying furnace 5 includes six blow-drying parts 7*a* to 7*f* inside the housing 6. Out of these blow-drying parts 7*a* to 7*f*, two blow-drying parts 7*a* and 7*b* are arranged between the openings 61 and 62 in order to dry the printing medium M moving along the upper-stage transfer direction Du, two blow-drying parts 7*c* and 7*d* are arranged between the openings 63 and 64 in order to dry the printing medium M moving along the middle-stage transfer direction Dm, and two blow-drying parts 7*e* and 7*f* are arranged between the openings 65 and 66 in order to dry the printing medium M moving along the lower-stage transfer direction Dl.

Figure 3:
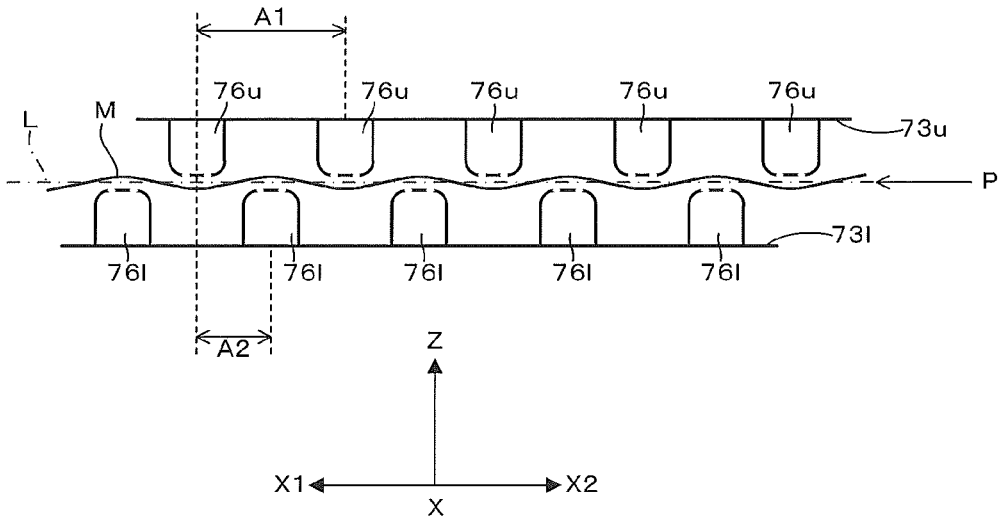
FIG. 3 is a schematic view showing the blow-drying part which is partially enlarged.
Figure 4:
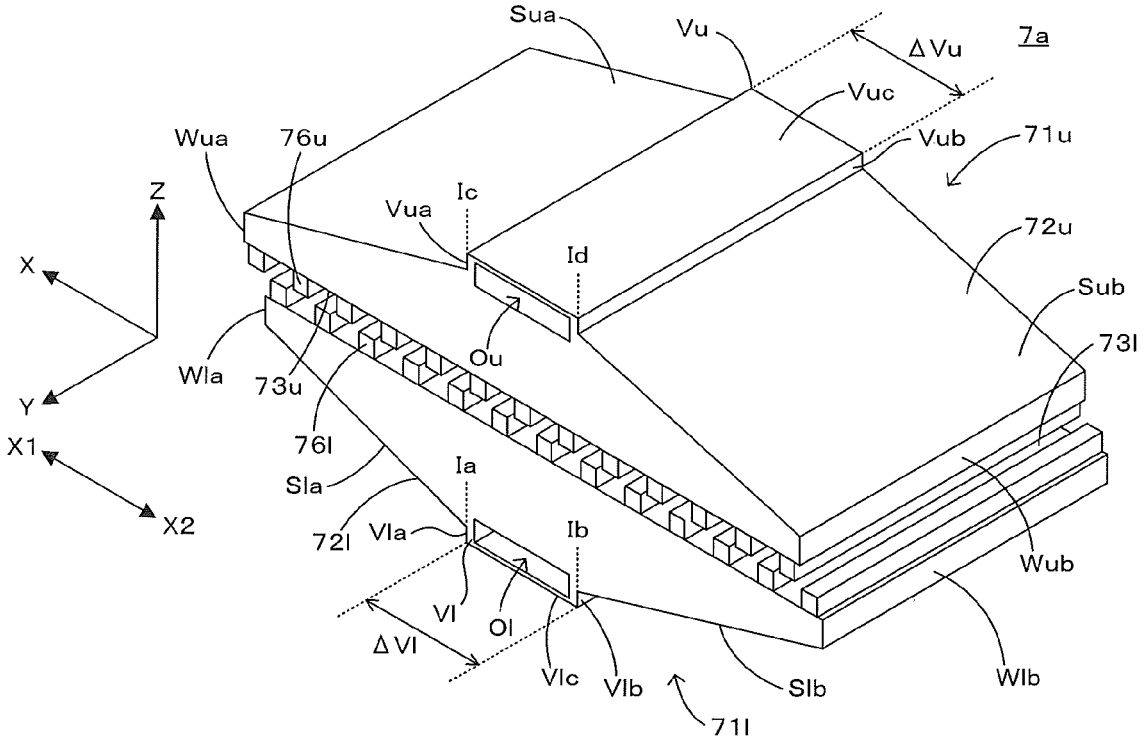
FIG. 4 is a partial perspective view schematically showing an appearance configuration of the blow-drying part.

FIG. 3 is a schematic view showing the blow-drying part which is partially enlarged, and FIG. 4 is a partial perspective view schematically showing an appearance configuration of the blow-drying part. Subsequently, the blow-drying parts 7*a* to 7*f* will be described with reference to FIGS. 3 and 4. Further, the blow-drying parts 7*a* to 7*f* each have a common constitution. For this reason, the common constitution will be mainly described with the blow-drying part 7*a* taken as an example, and then particular constitutions of the blow-drying parts 7*b* to 7*f* will be described.

The blow-drying part 7*a* is disposed to face the opening 61 in the upper-stage transfer direction Du. This blow-drying part 7*a* has blower units 71*u* and 71*l* disposed on the upper side and the lower side, respectively, to the printing medium M moving in the upper-stage transfer direction Du.

The upper blower unit 71*u* has a blower chamber 72*u* extending in the horizontal direction X on the upper side to the printing medium M. A lower surface of the blower chamber 72*u* is a nozzle arrangement plane 73*u* facing, from upward, the front surface M1 (upper surface) of the printing medium M facing upward. The nozzle arrangement plane 73*u* is a plane in parallel with the horizontal direction X and orthogonal to the vertical direction Z. Further, the blower unit 71*u* has a plurality of nozzles 76*u* aligned at a predetermined pitch A1 in the horizontal direction X on this nozzle arrangement plane 73*u*. Thus, the plurality of nozzles 76*u* are aligned between the nozzle arrangement plane 73*u* and the front surface M1 of the printing medium M to face the front surface M1 of the printing medium M.

The blower chamber 72*u* has a sidewall Wua positioned at an end on the X1 side and a sidewall Wub positioned at an end on the X2 side in the horizontal direction X. The sidewall Wua is a plate extending upward from an end of the nozzle arrangement plane 73*u* on the X1 side, and the sidewall Wub is a plate extending upward from another end of the nozzle arrangement plane 73*u* on the X2 side. Each of the sidewalls Wua and Wub is in parallel with the vertical direction Z and orthogonal to the horizontal direction X.

Further, the blower chamber 72*u* has a protruding part Vu positioned between both the sidewalls Wua and Wub in the horizontal direction X. This protruding part Vu is positioned upper than both the sidewalls Wua and Wub and is an upward protrusion. The protruding part Vu has a protruding wall Vua positioned at the end on the X1 side in the horizontal direction X and a protruding wall Vub positioned at the end on the X2 side in the horizontal direction X. Each of the protruding walls Vua and Vub is in parallel with the vertical direction Z and orthogonal to the horizontal direction X. Further, the protruding part Vu has an upper end surface Vuc extending between respective upper ends of the protruding walls Vua and Vub. This upper end surface Vuc is a plane orthogonal to the vertical direction Z and positioned at an upper end of the blower unit 71*u*.

Furthermore, the blower chamber 72*u* has a slope plate Sua extending from an upper end of the sidewall Wua to the protruding part Vu on the X1 side of the protruding part Vu and a slope plate Sub extending from an upper end of the sidewall Wub to the protruding part Vu on the X2 side of the protruding part Vu. The slope plate Sua is a plate which slopes up from the sidewall Wua toward the protruding part Vu at a certain angle with respect to the horizontal direction X. The slope plate Sub is a plate which slopes up from the sidewall Wub toward the protruding part Vu at a certain angle with respect to the horizontal direction X.

Then, the protruding wall Vua of the protruding part Vu protrudes upward from an end (upper end) of the slope plate Sua on the opposite side to the sidewall Wua, and the protruding wall Vub of the protruding part Vu protrudes upward from an end (upper end) of the slope plate Sub on the opposite side to the sidewall Wub. Thus, the protruding part Vu has a rectangular parallelepiped shape which is sandwiched between the slope plates Sua and Sub in the horizontal direction X and protrudes upward from the slope plates Sua and Sub, and has a width ΔVu in the horizontal direction X.

In the blower unit 71*u* having such a configuration, some of the plurality of nozzles 76*u*, which are positioned in the center in the horizontal direction X, face the protruding part Vu of the blower chamber 72*u* from the vertical direction Z.

Further, some of the plurality of nozzles 76*u*, which are positioned in an end portion on the X1 side in the horizontal direction X from the center, face the slope plate Sua from the vertical direction Z. Furthermore, some of the plurality of nozzles 76*u*, which are positioned in another end portion on the X2 side in the horizontal direction X from the center, face the slope plate Sub from the vertical direction Z. Specifically, the plurality of nozzles 76*u* include some nozzles 76*u* facing the protruding part Vu, some nozzles 76*u* facing the slope plate Sua, and some nozzles 76*u* facing the slope plate Sub.

Further, on one of the walls positioned at both the ends of the blower chamber 72*u* in a horizontal direction Y (orthogonal to the vertical direction Z and the horizontal direction X), provided is a supply port Ou which is opened in the horizontal direction Y. This supply port Ou is positioned between an imaginary straight line Ic which coincides with one end (the protruding wall Vua) of the protruding part Vu in the horizontal direction X and is in parallel with the vertical direction Z and an imaginary straight line Id which coincides with the other end (the protruding wall Vub) of the protruding part Vu in the horizontal direction X and is in parallel with the vertical direction Z. Specifically, the supply port Ou is positioned between both the ends of the protruding part Vu in the horizontal direction X. Moreover, in the horizontal direction X, the end of the protruding part Vu on the X1 side is positioned on the X1 side to an end of the supply port Ou on the X1 side, and the end of the protruding part Vu on the X2 side is positioned on the X2 side to another end of the supply port Ou on the X2 side. Further, part of the supply port Ou (part of the upper side thereof) is so formed as to overlap the protruding wall Vua (in other words, as to protrude to be upper than the respective upper ends of the slope plates Sua and Sub). To this supply port Ou, connected is a duct which supplies the hot air.

An internal space formed inside the blower chamber 72*u* has a taper whose thickness in the vertical direction Z decreases toward both the ends in the horizontal direction X in accordance with respective inclinations of the slope plates Sua and Sub. Then, the hot air is supplied to the internal space of the blower chamber 72*u* through the supply port Ou. Each of the nozzles 76*u* communicates with the internal space of the blower chamber 72*u* and the hot air supplied into the blower chamber 72*u* is injected onto the front surface M1 of the printing medium M from each nozzle 76*u*.

The lower blower unit 71*l* has a blower chamber 72*l* extending in the horizontal direction X on the lower side to the printing medium M. An upper surface of the blower chamber 72*l* is a nozzle arrangement plane 73*l* facing, from downward, the back surface M2 (lower surface) of the printing medium M facing downward. The nozzle arrangement plane 73*l* is a plane in parallel with the horizontal direction X and orthogonal to the vertical direction Z. Further, the blower unit 71*l* has a plurality of nozzles 76*l* aligned at a predetermined pitch A1 in the horizontal direction X on this nozzle arrangement plane 73*l*. Thus, the plurality of nozzles 76*l* are aligned between the nozzle arrangement plane 73*l* and the back surface M2 of the printing medium M to face the back surface M2 of the printing medium M.

The blower chamber 72*l* has a sidewall Wla positioned at an end on the X1 side in the horizontal direction X and a sidewall Wlb positioned at an end on the X2 side. The sidewall Wla is a plate extending downward from an end of the nozzle arrangement plane 73*l* on the X1 side, and the sidewall Wlb is a plate extending downward from another end of the nozzle arrangement plane 73*l* on the X2 side. Each of the sidewalls Wla and Wlb is in parallel with the vertical direction Z and orthogonal to the horizontal direction X.

Further, the blower chamber 72*l* has a protruding part Vl positioned between both the sidewalls Wla and Wlb in the horizontal direction X. This protruding part Vl is positioned lower than both the sidewalls Wla and Wlb and is a downward protrusion. The protruding part Vl has a protruding wall Vla positioned at the end on the X1 side in the horizontal direction X and a protruding wall Vlb positioned at the end on the X2 side in the horizontal direction X. Each of the protruding walls Vla and Vlb is in parallel with the vertical direction Z and orthogonal to the horizontal direction X. Further, the protruding part Vl has a lower end surface Vlc extending between respective lower ends of the protruding walls Vla and Vlb. This lower end surface Vlc is a plane orthogonal to the vertical direction Z and positioned at a lower end of the blower unit 71*l*.

Furthermore, the blower chamber 72*l* has a slope plate Sla extending from a lower end of the sidewall Wla to the protruding part Vl on the X1 side of the protruding part Vl and a slope plate Slb extending from a lower end of the sidewall Wlb to the protruding part Vl on the X2 side of the protruding part Vl. The slope plate Sla is a plate which slopes down from the sidewall Wla toward the protruding part Vl at a certain angle with respect to the horizontal direction X. The slope plate Slb is a plate which slopes down from the sidewall Wlb toward the protruding part Vl at a certain angle with respect to the horizontal direction X.

Then, the protruding wall Vla of the protruding part Vl protrudes downward from an end (lower end) of the slope plate Sla on the opposite side to the sidewall Wla, and the protruding wall Vlb of the protruding part Vl protrudes downward from an end (lower end) of the slope plate Slb on the opposite side to the sidewall Wlb. Thus, the protruding part Vl has a rectangular parallelepiped shape which is sandwiched between the slope plates Sla and Slb in the horizontal direction X and protrudes downward from the slope plates Sla and Slb, and has a width ΔVl in the horizontal direction X.

In the blower unit 71*l* having such a configuration, some of the plurality of nozzles 76*l*, which are positioned in the center in the horizontal direction X, face the protruding part Vl of the blower chamber 72*l* from the vertical direction Z. Further, some of the plurality of nozzles 76*l*, which are positioned at an end portion on the X1 side in the horizontal direction X from the center, face the slope plate Sla from the vertical direction Z. Furthermore, some of the plurality of nozzles 76*l*, which are positioned in another end portion on the X2 side in the horizontal direction X from the center, face the slope plate Slb from the vertical direction Z. Specifically, the plurality of nozzles 76*l* include some nozzles 76*l* facing the protruding part Vl, some nozzles 76*l* facing the slope plate Sla, and some nozzles 76*l* facing the slope plate Slb.

Further, on one of the walls positioned at both the ends of the blower chamber 72*l* in the horizontal direction Y, provided is a supply port Ol which is opened in the horizontal direction Y. This supply port Ol is positioned between an imaginary straight line Ia which coincides with one end (the protruding wall Vla) of the protruding part Vl in the horizontal direction X and is in parallel with the vertical direction Z and an imaginary straight line 1*b* which coincides with the other end (the protruding wall Vlb) of the protruding part Vl in the horizontal direction X and is in parallel with the vertical direction Z. Specifically, the supply port Ol is positioned between both the ends of the protruding part Vl in the horizontal direction X. Moreover, in the horizontal direction X, the end of the protruding part Vl on the X1 side is positioned on the X1 side to an end of the supply port Ol on the X1 side, and the end of the protruding part Vl on the X2 side is positioned on the X2 side to another end of the supply port Ol on the X2 side. Further, part of the supply port Ol (part of the lower side thereof) is so formed as to overlap the protruding wall Vla (in other words, as to protrude to be lower than the respective lower ends of the slope plates Sla and Slb). To this supply port Ol, connected is a duct which supplies the hot air.

An internal space formed inside the blower chamber 72*l* has a taper whose thickness in the vertical direction Z decreases toward both the ends in the horizontal direction X in accordance with respective inclinations of the slope plates Sla and Slb. Then, the hot air is supplied to the internal space of the blower chamber 72*l* through the supply port Ol. Each of the nozzles 76*l* communicates with the internal space of the blower chamber 72*l* and the hot air supplied to the blower chamber 72*l* is injected onto the back surface M2 of the printing medium M from each nozzle 76*l*.

Thus, the blower unit 71*u* and the blower unit 71*l* sandwich the printing medium M. In other words, the printing medium M moving in the upper-stage transfer direction Du passes through a dry path P formed between the blower unit 71*u* and the blower unit 71*l*. Thus, the blow-drying part 7*a* injects the hot air from the blower units 71*u* and 71*l* disposed on both sides of the dry path P onto the printing medium M passing through the dry path P after being loaded to the opening 61, to thereby dry the printing medium M, the dry path P facing the opening 61 in the upper-stage transfer direction Du.

Each upper nozzle 76*u* faces a range between adjacent two lower nozzles 76*l* in the horizontal direction X from upward, and each lower nozzle 76*l* faces a range between adjacent two upper nozzles 76*u* in the horizontal direction X from downward. Specifically, in the horizontal direction X, the upper nozzles 76*u* and the lower nozzles 76*l* are arranged alternately at a pitch A2 which is half the pitch A1, and in other words, arranged in a staggered manner. Such a staggered arrangement of the nozzles 76*u* and 76*l* is achieved by shifting respective positions of the blower chambers 72*u* and 72*l* relative to each other in the horizontal direction X. In other words, the blower chamber 72*l* protrudes toward the sidewall 6*a* side relative to the blower chamber 72*u* in the horizontal direction X.

In such a configuration, a portion of the printing medium M, which faces the upper nozzle 76*u*, is pushed downward by the hot air from this nozzle 76*u*, to lean downward from a transfer center line L, and a portion of the printing medium M, which faces the lower nozzle 76*l*, is pushed upward by the hot air from this nozzle 76*l*, to lean upward from the transfer center line L. Herein, the transfer center line L is a horizontal virtual straight line whose respective distances from the nozzles 76*u* and 76*l* in the vertical direction Z are equal to each other. Therefore, the printing medium M passing through the dry path P has a wavy shape between the upper side and the lower side of the transfer center line L. Thus, the printing medium M passes through the dry path P while waving.

Further, these blower units 71*u* and 71*l* are supported by the housing 6. Specifically, the blower units 71*u* and 71*l* are each attached to the housing 6 with a fastening member such as a screw or the like. Furthermore, by adjusting an attachment position of one of the blower units 71*u* and 71*l* in the vertical direction Z, it is possible to adjust the positional relation (interval) between the blower units 71*u* and 71*l* in the vertical direction Z.

The blow-drying part 7*b* is disposed on the downstream side of the blow-drying part 7*a* in the upper-stage transfer direction Du and faces the opening 62 in the upper-stage transfer direction Du. Like the blow-drying part 7*a*, this blow-drying part 7*b* has the blower units 71*u* and 71*l* which sandwich, from the vertical direction Z, the printing medium M moving along the upper-stage transfer direction Du. Further, in the blow-drying part 7*b*, the blower unit 71*u* protrudes toward the sidewall 6*b* side relative to the blower unit 71*l* in the horizontal direction X. This blow-drying part 7*b* injects the hot air from the blower units 71*u* and 71*l* disposed on both sides of the dry path P onto the printing medium M passing through the dry path P before being unloaded from the opening 62, to thereby dry the printing medium M, the dry path P facing the opening 62 in the upper-stage transfer direction Du.

The blow-drying part 7*c* is disposed, facing the opening 63 from the middle-stage transfer direction Dm. Like the blow-drying part 7*a*, this blow-drying part 7*c* has the blower units 71*u* and 71*l* which sandwich the printing medium M from the vertical direction Z. Since the blow-drying part 7*c* is disposed with respect to the middle-stage transfer direction Dm, however, the blower units 71*u* and 71*l* of the blow-drying part 7*c* sandwich, from the vertical direction Z, the printing medium M moving along the middle-stage transfer direction Dm. Further, since the printing medium M is turned upside down while being folded over by the rollers 52 and 53, the blower unit 71*u* injects the hot air onto the back surface M2 (upper surface) of the printing medium M and the blower unit 71*l* injects the hot air onto the front surface M1 (lower surface) of the printing medium M. Furthermore, in the blow-drying part 7*c*, the blower unit 71*l* protrudes toward the sidewall 6*b* side relative to the blower unit 71*u* in the horizontal direction X. This blow-drying part 7*c* injects the hot air from the blower units 71*u* and 71*l* disposed on both sides of the dry path P onto the printing medium M passing through the dry path P after being loaded to the opening 63, to thereby dry the printing medium M, the dry path P facing the opening 63 in the middle-stage transfer direction Dm.

The blow-drying part 7*d* is disposed on the downstream side of the blow-drying part 7*c* in the middle-stage transfer direction Dm and faces the opening 64 from the middle-stage transfer direction Dm. Like the blow-drying part 7*c*, this blow-drying part 7*d* has the blower units 71*u* and 71*l* which sandwich, from the vertical direction Z, the printing medium M moving in the middle-stage transfer direction Dm. Further, in the blow-drying part 7*d*, the blower unit 71*u* protrudes toward the sidewall 6*a* side relative to the blower unit 71*l* in the horizontal direction X. This blow-drying part 7*d* injects the hot air from the blower units 71*u* and 71*l* disposed on both sides of the dry path P onto the printing medium M passing through the dry path P before being unloaded from the opening 64, to thereby dry the printing medium M, the dry path P facing the opening 64 in the middle-stage transfer direction Dm.

The blow-drying part 7*e* is disposed, facing the opening 65 from the lower-stage transfer direction Dl. Like the blow-drying part 7*a*, this blow-drying part 7*e* has the blower units 71*u* and 71*l* which sandwich the printing medium M from the vertical direction Z. Since the blow-drying part 7*e* is disposed with respect to the lower-stage transfer direction Dl, however, the blower units 71*u* and 71*l* of the blow-drying part 7*e* sandwich, from the vertical direction Z, the printing medium M moving along the lower-stage transfer direction Dl. Further, in the blow-drying part 7*e*, the blower unit 71*l* protrudes toward the sidewall 6*a* side relative to the blower unit 71*u* in the horizontal direction X. This blow-drying part 7*e* injects the hot air from the blower units 71*u* and 71*l* disposed on both sides of the dry path P onto the printing medium M passing through the dry path P after being loaded to the opening 65, to thereby dry the printing medium M, the dry path P facing the opening 65 in the lower-stage transfer direction Dl.

The blow-drying part 7*f* is disposed on the downstream side of the blow-drying part 7*e* in the lower-stage transfer direction Dl and faces the opening 66 from the lower-stage transfer direction Dl. Like the blow-drying part 7*e*, this blow-drying part 7*f* has the blower units 71*u* and 71*l* which sandwich, from the vertical direction Z, the printing medium M moving in the lower-stage transfer direction Dl. Further, in the blow-drying part 7*f*, the blower unit 71*u* protrudes toward the sidewall 6*b* side relative to the blower unit 71*l* in the horizontal direction X. This blow-drying part 7*f* injects the hot air from the blower units 71*u* and 71*l* disposed on both sides of the dry path P onto the printing medium M passing through the dry path P before being unloaded from the opening 66, to thereby dry the printing medium M, the dry path P facing the opening 66 in the lower-stage transfer direction Dl.

Further, the post-stage drying furnace 5 includes exhaust parts 8*a* and 8*b* inside the housing 6 and the exhaust parts 8*a* and 8*b* exhaust air from the inside of the housing 6 to the outside thereof. The exhaust part 8*a* is disposed adjacent to the sidewall 6*a* at the end of the X2 side in the housing 6 and positioned between the blow-drying parts 7*a*, 7*d*, 7*e* and the sidewall 6*a*. The exhaust part 8*b* is disposed adjacent to the sidewall 6*b* at the end of the X1 side in the housing 6 and positioned between the blow-drying parts 7*b*, 7*c*, 7*f* and the sidewall 6*b*. These exhaust parts 8*a* and 8*b* each include a common constitution. For this reason, the common constitution will be mainly described with the exhaust part 8*a* taken as an example, and then a particular constitution of the exhaust part 8*b* will be described.

The exhaust part 8*a* has four exhaust chambers 81-84 aligned in the vertical direction Z. The exhaust chamber 81 is disposed on the upper side to the printing medium M moving between the opening 61 and the opening 62 in the upper-stage transfer direction Du. The exhaust chamber 82 is disposed between the printing medium M moving between the opening 61 and the opening 62 in the upper-stage transfer direction Du and the printing medium M moving between the opening 63 and the opening 64 in the middle-stage transfer direction Dm. The exhaust chamber 84 is disposed on the lower side to the printing medium M moving between the opening 65 and the opening 66 in the lower-stage transfer direction Dl. Like the exhaust part 8*a*, the exhaust part 8*b* also has four exhaust chambers 81-84. Then, the respective chambers 81-84 of the exhaust parts 8*a* and 8*b* exhaust the air inside the housing 6 to the outside thereof.

Figure 5:
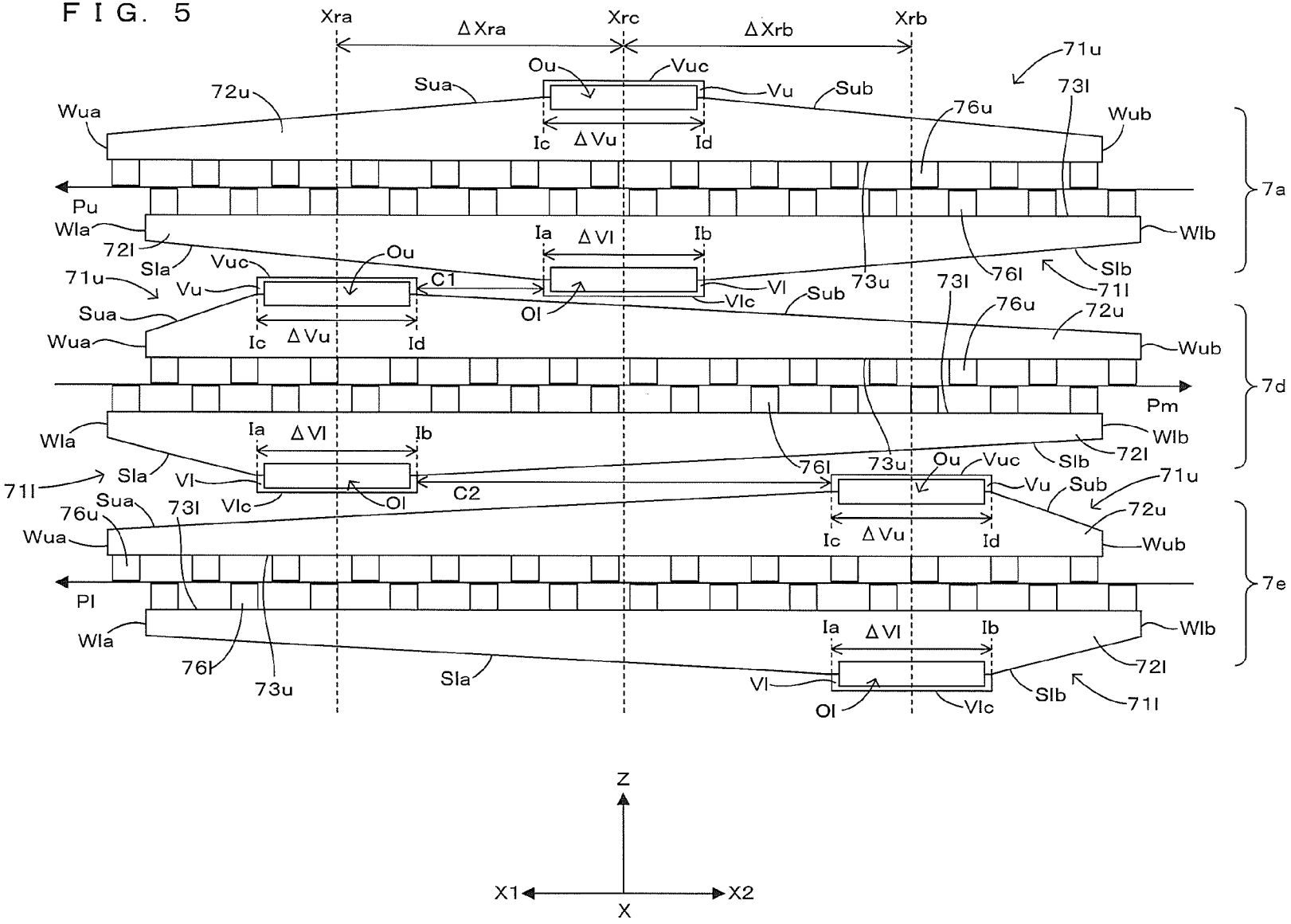
FIG. 5 is an elevational view schematically showing the three blow-drying parts on the right side of FIG. 2, among the six blow-drying parts included in the post-stage drying furnace.

FIG. 5 is an elevational view schematically showing the three blow-drying parts on the right side of FIG. 2, among the six blow-drying parts included in the post-stage drying furnace. In this figure, reference signs Pu, Pm, Pl are given to the dry paths P extending in the horizontal direction X along the upper-stage transfer direction Du, the middle-stage transfer direction Dm, and the lower-stage transfer direction Dl, respectively.

As shown in FIG. 5, in the blow-drying parts 7*a*, 7*d*, 7*e*, the respective positions of the protruding parts Vu, Vl in the horizontal direction X are different from one another.

Specifically, each of the protruding part Vu of the blower unit 71*u* and the protruding part Vl of the blower unit 71*l* in the blow-drying part 7*a* is positioned at a predetermined center position Xrc, each of the protruding part Vu of the blower unit 71*u* and the protruding part Vl of the blower unit 71*l* in the blow-drying part 7*d* is positioned at one-side position Xra which is deviated from the center position Xrc to the X1 side in the horizontal direction X, and each of the protruding part Vu of the blower unit 71*u* and the protruding part Vl of the blower unit 71*l* in the blow-drying part 7*e* is positioned at the other-side position Xrb which is deviated from the center position Xrc to the X2 side in the horizontal direction X.

Further, each of the positions Xra, Xrb, Xrc corresponds to coordinates in the horizontal direction X. The position of the protruding part Vu is represented as a position (coordinates) of the center of the protruding part Vu in the horizontal direction X, and the position of the protruding part Vl is represented as a position (coordinates) of the center of the protruding part Vl in the horizontal direction X. Furthermore, in this exemplary case, the interval ΔXra between the one-side position Xra and the center position Xrc is equal to the interval ΔXrb between the other-side position Xrb and the center position Xrc in the horizontal direction X.

Respective widths ΔVu of the protruding parts Vu in the blow-drying parts 7*a*, 7*d*, 7*e* are equal to one another, and respective widths ΔVl of the protruding parts Vl in the blow-drying parts 7*a*, 7*d*, 7*e* are equal to one another. Further, the width ΔVu and the width ΔVl are equal to each other. Furthermore, each of the width ΔVu and the width ΔVl is shorter than the interval ΔXra and shorter than the interval ΔXrb.

Between the upper-stage dry path Pu and the middle-stage dry path Pm, the blower unit 71*l* of the blow-drying part 7*a* and the blower unit 71*u* of the blow-drying part 7*d* are so arranged vertically as to at least partially overlap each other when viewed from the vertical direction Z. Among these blower units, the upper blower unit 71*l* (one blower unit) faces the upper-stage dry path Pu from downward and injects the hot air onto the printing medium M passing through the upper-stage dry path Pu. Further, the lower blower unit 71*u* (the other blower unit) faces the middle-stage dry path Pm from upward and injects the hot air onto the printing medium M passing through the middle-stage dry path Pm.

Furthermore, the protruding part Vl of the blower unit 71*l* is positioned at the center position Xrc while the protruding part Vu of the blower unit 71*u* is positioned at the one-side position Xra, and the protruding part Vl and the protruding part Vu deviate from each other in the horizontal direction X. For this reason, in the horizontal direction X, the protruding part Vl and the protruding part Vu are separated by a clearance C1. Particularly, in the vertical direction Z, the lower end surface Vlc of the protruding part Vl is positioned lower than the upper end surface Vuc of the protruding part Vu, and in other words, the upper end surface Vuc of the protruding part Vu is positioned upper than the lower end surface Vlc of the protruding part Vl. Specifically, when viewed from the horizontal direction X, the protruding part Vl and the protruding part Vu partially overlap each other. It is thereby possible to compactly arrange the blower unit 71*l* and the blower unit 71*u* between the upper-stage dry path Pu and the middle-stage dry path Pm and further to reduce the interval between the upper-stage dry path Pu and the middle-stage dry path Pm in the vertical direction Z.

Between the middle-stage dry path Pm and the lower-stage dry path Pl, the blower unit 71*l* of the blow-drying part 7*d* and the blower unit 71*u* of the blow-drying part 7*e* are so arranged vertically as to at least partially overlap each other when viewed from the vertical direction Z. Among these blower units, the upper blower unit 71*l* (one blower unit) faces the middle-stage dry path Pm from downward and injects the hot air onto the printing medium M passing through the middle-stage dry path Pm. Further, the lower blower unit 71*u* (the other blower unit) faces the lower-stage dry path Pl from upward and injects the hot air onto the printing medium M passing through the lower-stage dry path Pl.

Furthermore, the protruding part Vl of the blower unit 71*l* is positioned at the one-side position Xra while the protruding part Vu of the blower unit 71*u* is positioned at the other-side position Xrb, and the protruding part Vl and the protruding part Vu deviate from each other in the horizontal direction X. For this reason, in the horizontal direction X, the protruding part Vl and the protruding part Vu are separated by a clearance C2 (wider than the clearance C1). Particularly, in the vertical direction Z, the lower end surface Vlc of the protruding part Vl is positioned lower than the upper end surface Vuc of the protruding part Vu, and in other words, the upper end surface Vuc of the protruding part Vu is positioned upper than the lower end surface Vlc of the protruding part Vl. Specifically, when viewed from the horizontal direction X, the protruding part Vl and the protruding part Vu partially overlap each other. It is thereby possible to compactly arrange the blower unit 71*l* and the blower unit 71*u* between the middle-stage dry path Pm and the lower-stage dry path Pl and further to reduce the interval between the middle-stage dry path Pm and the lower-stage dry path Pl in the vertical direction Z.

Further, the blower unit 71*u* of the blow-drying part 7*a* and the blower unit 71*l* of the blow-drying part 7*a* have the same constitution, and by inverting the blower unit 71*u* of the blow-drying part 7*a* up and down, the blower unit 71*u* of the blow-drying part 7*a* can be used as the blower unit 71*l* of the blow-drying part 7*a*. The blower unit 71*u* of the blow-drying part 7*d* and the blower unit 71*u* of the blow-drying part 7*e* have the same constitution, and by inverting the blower unit 71*u* of the blow-drying part 7*d* left and right, the blower unit 71*u* of the blow-drying part 7*d* can be used as the blower unit 71*u* of the blow-drying part 7*e*. Furthermore, the blower unit 71*l* of the blow-drying part 7*d* and the blower unit 71*l* of the blow-drying part 7*e* have the same constitution, and by inverting the blower unit 71*l* of the blow-drying part 7*d* left and right, the blower unit 71*l* of the blow-drying part 7*d* can be used as the blower unit 71*l* of the blow-drying part 7*e*.

Figure 6:
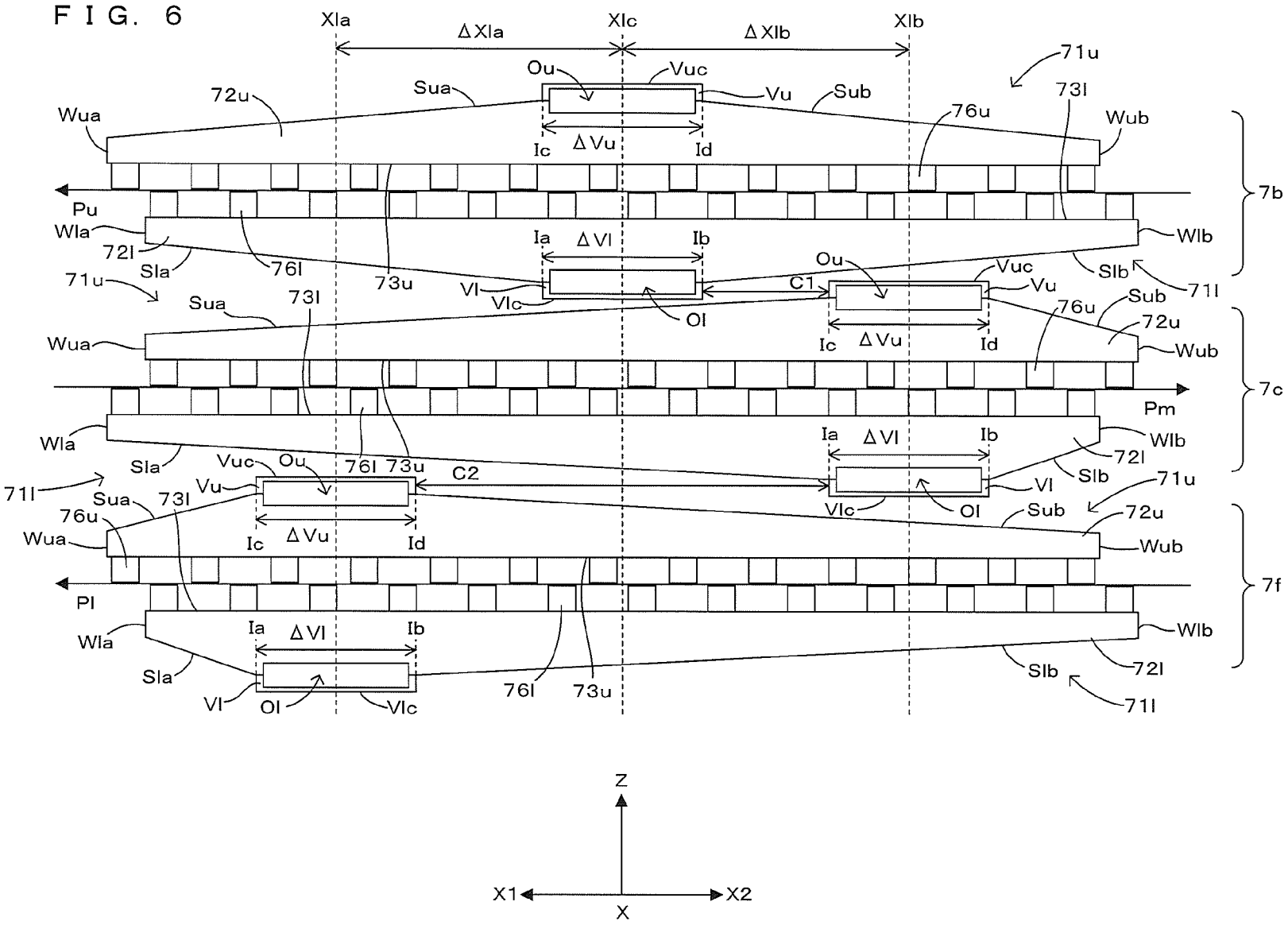
FIG. 6 is an elevational view schematically showing the three blow-drying parts on the left side of FIG. 2, among the six blow-drying parts included in the post-stage drying furnace.

FIG. 6 is an elevational view schematically showing the three blow-drying parts on the left side of FIG. 2, among the six blow-drying parts included in the post-stage drying furnace. Also in this figure, reference signs Pu, Pm, Pl are given to the dry paths P extending in the horizontal direction X along the upper-stage transfer direction Du, the middle-stage transfer direction Dm, and the lower-stage transfer direction Dl, respectively.

As shown in FIG. 6, in the blow-drying parts 7*b*, 7*c*, 7*f*, the respective positions of the protruding parts Vu, Vl in the horizontal direction X are different from one another. Specifically, each of the protruding part Vu of the blower unit 71*u* and the protruding part Vl of the blower unit 71*l* in the blow-drying part 7*b* is positioned at a predetermined center position Xlc, each of the protruding part Vu of the blower unit 71*u* and the protruding part Vl of the blower unit 71*l* in the blow-drying part 7*c* is positioned at the other-side position Xlb which is deviated from the center position Xlc to the X2 side in the horizontal direction X, and each of the protruding part Vu of the blower unit 71*u* and the protruding part Vl of the blower unit 71*l* in the blow-drying part 7*f* is positioned at one-side position Xla which is deviated from the center position Xlc to the X1 side in the horizontal direction X.

Further, each of the positions Xla, Xlb, and Xlc corresponds to coordinates in the horizontal direction X. In this exemplary case, the interval ΔXla between the one-side position Xla and the center position Xlc is equal to the interval ΔXlb between the other-side position Xlb and the center position Xlc in the horizontal direction X.

Respective widths ΔVu of the protruding parts Vu in the blow-drying parts 7*b*, 7*c*, 7*f* are equal to one another, and respective widths ΔVl of the protruding parts Vl in the blow-drying parts 7*b*, 7*c*, 7*f* are equal to one another. Further, the width ΔVu and the width ΔVl are equal to each other. Furthermore, each of the width ΔVu and the width ΔVl is shorter than the interval ΔXla and shorter than the interval ΔXlb.

Between the upper-stage dry path Pu and the middle-stage dry path Pm, the blower unit 71*l* of the blow-drying part 7*b* and the blower unit 71*u* of the blow-drying part 7*c* are so arranged vertically as to at least partially overlap each other when viewed from the vertical direction Z. Among these blower units, the upper blower unit 71*l* (one blower unit) faces the upper-stage dry path Pu from downward and injects the hot air onto the printing medium M passing through the upper-stage dry path Pu. Further, the lower blower unit 71*u* (the other blower unit) faces the middle-stage dry path Pm from upward and injects the hot air onto the printing medium M passing through the middle-stage dry path Pm.

Furthermore, the protruding part Vl of the blower unit 71*l* is positioned at the center position Xlc while the protruding part Vu of the blower unit 71*u* is positioned at the other-side position Xlb, and the protruding part Vl and the protruding part Vu deviate from each other in the horizontal direction X. For this reason, in the horizontal direction X, the protruding part Vl and the protruding part Vu are separated by the clearance C1. Particularly, in the vertical direction Z, the lower end surface Vlc of the protruding part Vl is positioned lower than the upper end surface Vuc of the protruding part Vu, and in other words, the upper end surface Vuc of the protruding part Vu is positioned upper than the lower end surface Vlc of the protruding part Vl. Specifically, when viewed from the horizontal direction X, the protruding part Vl and the protruding part Vu partially overlap each other. It is thereby possible to compactly arrange the blower unit 71*l* and the blower unit 71*u* between the upper-stage dry path Pu and the middle-stage dry path Pm and further to reduce the interval between the upper-stage dry path Pu and the middle-stage dry path Pm in the vertical direction Z.

Between the middle-stage dry path Pm and the lower-stage dry path Pl, the blower unit 71*l* of the blow-drying part 7*c* and the blower unit 71*u* of the blow-drying part 7*f* are so arranged vertically as to at least partially overlap each other when viewed from the vertical direction Z. Among these blower units, the upper blower unit 71*l* (one blower unit) faces the middle-stage dry path Pm from downward and injects the hot air onto the printing medium M passing through the middle-stage dry path Pm. Further, the lower blower unit 71*u* (the other blower unit) faces the lower-stage dry path Pl from upward and injects the hot air onto the printing medium M passing through the lower-stage dry path Pl.

Furthermore, the protruding part Vl of the blower unit 71*l* is positioned at the other-side position Xlb while the protruding part Vu of the blower unit 71*u* is positioned at the one-side position Xla, and the protruding part Vl and the protruding part Vu deviate from each other in the horizontal direction X. For this reason, in the horizontal direction X, the protruding part Vl and the protruding part Vu are separated by the clearance C2 (wider than the clearance C1). Particularly, in the vertical direction Z, the lower end surface Vlc of the protruding part Vl is positioned lower than the upper end surface Vuc of the protruding part Vu, and in other words, the upper end surface Vuc of the protruding part Vu is positioned upper than the lower end surface Vlc of the protruding part Vl. Specifically, when viewed from the horizontal direction X, the protruding part Vl and the protruding part Vu partially overlap each other. It is thereby possible to compactly arrange the blower unit 71*l* and the blower unit 71*u* between the middle-stage dry path Pm and the lower-stage dry path Pl and further to reduce the interval between the middle-stage dry path Pm and the lower-stage dry path Pl in the vertical direction Z.

Further, the blower unit 71*u* of the blow-drying part 7*b* and the blower unit 71*l* of the blow-drying part 7*b* have the same constitution, and by inverting the blower unit 71*u* of the blow-drying part 7*b* up and down, the blower unit 71*u* of the blow-drying part 7*b* can be used as the blower unit 71*l* of the blow-drying part 7*b*. The blower unit 71*u* of the blow-drying part 7*c* and the blower unit 71*u* of the blow-drying part 7*f* have the same constitution, and by inverting the blower unit 71*u* of the blow-drying part 7*c* left and right, the blower unit 71*u* of the blow-drying part 7*c* can be used as the blower unit 71*u* of the blow-drying part 7*f*. Furthermore, the blower unit 71*l* of the blow-drying part 7*c* and the blower unit 71*l* of the blow-drying part 7*f* have the same constitution, and by inverting the blower unit 71*l* of the blow-drying part 7*c* left and right, the blower unit 71*l* of the blow-drying part 7*c* can be used as the blower unit 71*l* of the blow-drying part 7*f*.

The above-described embodiment produces effects described below. Further, the effects are produced on the following combinations in the same manner. So, hereinafter, the description will be mainly made on Combination 1.

Combination 1: the blower unit 71*l* of the blow-drying part 7*a* and the blower unit 71*u* of the blow-drying part 7*d* which are vertically arranged between the upper-stage dry path Pu and the middle-stage dry path Pm, Combination 2: the blower unit 71*l* of the blow-drying part 7*d* and the blower unit 71*u* of the blow-drying part 7*e* which are vertically arranged between the middle-stage dry path Pm and the lower-stage dry path Pl, Combination 3: the blower unit 71*l* of the blow-drying part 7*b* and the blower unit 71*u* of the blow-drying part 7*c* which are vertically arranged between the upper-stage dry path Pu and the middle-stage dry path Pm, and Combination 4: the blower unit 71*l* of the blow-drying part 7*c* and the blower unit 71*u* of the blow-drying part 7*f* which are vertically arranged between the middle-stage dry path Pm and the lower-stage dry path Pl.

Specifically, in the above-described embodiment, the blower unit 71*l* of the blow-drying part 7*a* and the blower unit 71*u* of the blow-drying part 7*d* are so arranged vertically between the upper-stage dry path Pu and the middle-stage dry path Pm as to at least partially overlap each other when viewed from the vertical direction Z. Particularly, the two blower units 71*l*, 71*u* are arranged so that among the two blower units 71*l*, 71*u*, the lower end part (lower end surface Vlc) of the upper blower unit 71*l* (one blower unit) deviate from the upper end part (upper end surface Vuc) of the lower blower unit 71*u* (the other blower unit) in the horizontal direction X and protrude downward from the upper end part (upper end surface Vuc) in the vertical direction Z. Thus, it is possible to compactly arrange the two blower units 71*l*, 71*u* vertically between the two dry paths Pu, Pm and further suppress upsizing of the post-stage drying furnace 5.

Further, the blower unit 71*l* (one blower unit) has an appearance configuration in which the slope plate Sla (first slope part) and the slope plate Slb (second slope part) extend from the sidewall Wla (first sidewall) and the sidewall Wlb (second sidewall), respectively, at both ends of the blower unit 71*l* (one blower unit) to the protruding part Vl (one protruding part) positioned between these sidewalls. Further, the blower unit 71*u* (the other blower unit) has an appearance configuration in which the slope plate Sua (third slope part) and the slope plate Sub (fourth slope part) extend from the sidewall Wua (third sidewall) and the sidewall Wub (fourth sidewall), respectively, at both ends of the blower unit 71*u* (the other blower unit) to the protruding part Vu (the other protruding part) positioned between these sidewalls. Then, in the blower unit 71*l*, the protruding part Vl protrudes downward from the slope plate Sla and the slope plate Slb and the lower end surface Vlc of the protruding part Vl forms the lower end part of the blower unit 71*l*, and in the blower unit 71*u*, the protruding part Vu protrudes upward from the slope plate Sua and the slope plate Sub and the upper end surface Vuc of the protruding part Vu forms the upper end part of the blower unit 71*u*. Thus, in a case where the blower unit 71*l* and the blower unit 71*u* which have the protruding part Vl and the protruding part Vu, respectively, are vertically arranged, these protruding parts Vl, Vu are bulky and there arises a possibility that the placement space for these blower units may become larger. In contrast to this, these blower units 71*l*, 71*u* are arranged so that the lower end surface Vlc of the protruding part Vl in the upper blower unit 71*l* protrudes to be lower than the upper end surface Vuc of the protruding part Vu in the lower blower unit 71*u*. As a result, it becomes possible to compactly arrange these blower units 71*l*, 71*u*.

Furthermore, the post-stage drying furnace 5 is configured so that the slope plate Sla slopes at a certain angle (first angle) with respect to the horizontal direction X, the slope plate Slb slopes at a certain angle (second angle) with respect to the horizontal direction X, the slope plate Sua (third slope part) slopes at a certain angle (third angle) with respect to the horizontal direction X, and the slope plate Sub (fourth slope part) slopes at a certain angle (fourth angle) with respect to the horizontal direction X. In such a configuration, the slope plates Sla, Slb, Sua, Sub can be formed of plates attached, being sloped at the predetermined angles, respectively, and therefore, it is possible to simply configure the post-stage drying furnace 5.

Further, the blower unit 71*l* has a plurality of nozzles 76*l* (one-side nozzles) which are arranged in an extending direction (horizontal direction X) of the upper-stage dry path Pu, and each of the nozzles 76*l* faces, from downward, the printing medium M passing through the upper-stage dry path Pu. Then, the hot air supplied into the blower chamber 72*l* (one blower chamber) having the sidewall Wla, the sidewall Wlb, and the protruding part Vl is injected from each of the plurality of nozzles 76*l*. In such a configuration, the slope plate Sla and the slope plate Slb which extend from one and the other ends of the blower unit 71*l*, respectively, to the protruding part Vl slope down toward the protruding part Vl to the horizontal direction X, and a taper which tapers toward both ends is provided inside the blower chamber 72*l*. Therefore, the gas can be injected uniformly from the plurality of nozzles 76*l* while suppressing any effect of pressure loss.

Similarly, the blower unit 71*u* has a plurality of nozzles 76*u* (the other-side nozzles) which are arranged in an extending direction (horizontal direction X) of the middle-stage dry path Pm, and each of the nozzles 76*u* faces, from upward, the printing medium M passing through the middle-stage dry path Pm. Then, the hot air supplied into the blower chamber 72*u* (the other blower chamber) having the sidewall Wua, the sidewall Wub, and the protruding part Vu is injected from each of the plurality of nozzles 76*u*. In such a configuration, the slope plate Sua and the slope plate Sub which extend from one and the other ends of the blower unit 71*u*, respectively, to the protruding part Vu slope up toward the protruding part Vu to the horizontal direction X, and a taper which tapers toward both ends is provided inside the blower chamber 72*u*. Therefore, the gas can be injected uniformly from the plurality of nozzles 76*u* while suppressing any effect of pressure loss.

Further, in the blower unit 71*l*, the supply port Ol is provided between the imaginary straight line Ia (first imaginary straight line) which coincides with one end of the protruding part Vl in the horizontal direction X and is in parallel with the vertical direction Z and the imaginary straight line Ib (second imaginary straight line) which coincides with the other end of the protruding part Vl in the horizontal direction X and is in parallel with the vertical direction Z, and the hot air is supplied to the inside of the blower chamber 72*l* from the supply port Ol. Furthermore, in the blower unit 71*u*, the supply port Ou is provided between the imaginary straight line Ic (third imaginary straight line) which coincides with one end of the protruding part Vu in the horizontal direction X and is in parallel with the vertical direction Z and the imaginary straight line Id (fourth imaginary straight line) which coincides with the other end of the protruding part Vu in the horizontal direction X and is in parallel with the vertical direction Z, and the hot air is supplied to the inside of the blower chamber 72*u* from the supply port Ou. In such a configuration, the hot air can be supplied from a space between the tapers on both sides, which are provided inside the blower chambers 72*l*, 72*u*, and it is possible to uniformly inject the gas from the plurality of nozzles 76*l*, 76*u*.

Further, the supply port Ol at least partially overlaps the protruding part Vl, and the supply port Ou at least partially overlaps the protruding part Vu. In such a configuration, since respective distances between the supply ports Ol, Ou from which the hot air is supplied and the nozzles 76*l*, 76*u* (in other words, the nozzle arrangement planes 73*l*, 73*u*) can be ensured in the vertical direction Z, it is possible to uniformly inject the hot air from the plurality of nozzles 76*l*, 76*u*.

In the above-described embodiment, the post-stage drying furnace 5 corresponds to one example of a "web drying apparatus" of the present invention, the blower units 71*u*, 71*l* correspond to one example of "two blower units" of the present invention, the blower unit 71*l* corresponds to one example of "one blower unit" of the present invention, the blower unit 71*u* corresponds to one example of "the other blower unit" of the present invention, the blower chamber 72*l* corresponds to one example of "one chamber" of the present invention, the blower chamber 72*u* corresponds to one example of "the other chamber" of the present invention, the nozzle 76*l* corresponds to one example of "one-side nozzle" of the present invention, the nozzle 76*u* corresponds to one example of "the other-side nozzle" of the present invention, the imaginary straight line Ia corresponds to one example of a "first imaginary straight line" of the present invention, the imaginary straight line Ib corresponds to one example of a "second imaginary straight line" of the present invention, the imaginary straight line Ic corresponds to one example of a "third imaginary straight line" of the present invention, the imaginary straight line Id corresponds to one example of a "fourth imaginary straight line" of the present invention, the supply port Ol corresponds to one example of "one opening" of the present invention, the supply port Ou corresponds to one example of "the other opening" of the present invention, the slope plate Sla corresponds to one example of a "first slope part" of the present invention, the slope plate Slb corresponds to one example of a "second slope part" of the present invention, the slope plate Sua corresponds to one example of a "third slope part" of the present invention, the slope plate Sub corresponds to one example of a "fourth slope part" of the present invention, the protruding part Vl corresponds to one example of "one protruding part" of the present invention, the protruding part Vu corresponds to one example of "the other protruding part" of the present invention, the lower end surface Vlc corresponds to one example of a "lower end part" or a "lower end surface" of the present invention, the upper end surface Vuc corresponds to one example of an "upper end part" or an "upper end surface" of the present invention, the sidewall Wla corresponds to one example of a "first sidewall" of the present invention, the sidewall Wlb corresponds to one example of a "second sidewall" of the present invention, the sidewall Wua corresponds to one example of a "third sidewall" of the present invention, and the sidewall Wub corresponds to one example of a "fourth sidewall" of the present invention. Further, the upper-stage dry path Pu and the middle-stage dry path Pm correspond to one example of "upper dry path and lower dry path" of the present invention, or alternatively the middle-stage dry path Pm and the lower-stage dry path Pl correspond to one example of "upper dry path and lower dry path" of the present invention.

The present invention is not limited to the above-described embodiment, but numerous modifications and variations other than those described above can be devised without departing from the scope of the invention. For example, the positional relation in the horizontal direction X between the protruding part Vl and the protruding part Vu may be changed as appropriate. FIG. 7 is a view showing a variation of the positional relation between the protruding parts in a tabular form. For example, the positional relation between the protruding part Vl of the blower unit 71*l* in the blow-drying part 7*a* and the protruding part Vu of the blower unit 71*u* in the blow-drying part 7*d* may be any one of the positional relations R1 to R6 shown in FIG. 7. The same applies to the positional relation between the protruding part Vl of the blower unit 71*l* in the blow-drying part 7*d* and the protruding part Vu of the blower unit 71*u* in the blow-drying part 7*e*, the positional relation between the protruding part Vl of the blower unit 71*l* in the blow-drying part 7*b* and the protruding part Vu of the blower unit 71*u* in the blow-drying part 7*c*, and the positional relation between the protruding part Vl of the blower unit 71*l* in the blow-drying part 7*c* and the protruding part Vu of the blower unit 71*u* in the blow-drying part 7*f*.

Moreover, the position of the protruding part Vl or the protruding part Vu does not necessarily need to be any one of the positions Xla, Xlc, and Xlb (positions Xra, Xrc, and Xrb), but may deviate from these positions.

Further, the number of stages of the dry path P does not need to be three but may be two or four or more.

Furthermore, the post-stage drying furnace 5 does not need to include the constituent elements shown in FIGS. 5 and 6 but may be configured to include, for example, only the constituent elements shown in FIG. 5.

Further, the appearance configuration of the blower unit 71*l* is not limited to that described above. There may be a configuration, for example, where the protruding part Vl is omitted and the respective upper ends of the slope plates Sla and Slb are connected to each other with a plane. In this exemplary configuration, the plane corresponds to the "lower end part" or the "lower end surface" of the present invention.

Similarly, the appearance configuration of the blower unit 71*u* is not limited to that described above. There may be a configuration, for example, where the protruding part Vu is omitted and the respective upper ends of the slope plates Sua and Sub are connected to each other with a plane. In this exemplary configuration, the plane corresponds to the "upper end part" or the "upper end surface" of the present invention.

Further, the position of the supply port Ol or the supply port Ou may be changed.

Furthermore, the arrangement of the nozzles 76*u*, 76*l* may be changed as appropriate, and the nozzles 76*u*, 76*l* may be so arranged as to face the vertical direction Z.

INDUSTRIAL APPLICABILITY

The present invention can be applied to general technology for drying web by injecting gas.

As describe above, the web drying apparatus may be configured so that the one blower unit has one protruding part positioned between the first sidewall and the second sidewall, a first slope part extending from the first sidewall to the one protruding part and sloping down toward the one protruding part with respect to the horizontal direction, and a second slope part extending from the second sidewall to the one protruding part and sloping down toward the one protruding part with respect to the horizontal direction, and the one protruding part protrudes downward from the first slope part and the second slope part and a lower end surface of the one protruding part corresponds to the lower end part, and the other blower unit has the other protruding part positioned between the third sidewall and the fourth sidewall, a third slope part extending from the third sidewall to the other protruding part and sloping up toward the other protruding part with respect to the horizontal direction, and a fourth slope part extending from the fourth sidewall to the other protruding part and sloping up toward the other protruding part with respect to the horizontal direction, and the other protruding part protrudes upward from the third slope part and the fourth slope part and an upper end surface of the other protruding part corresponds to the upper end part.

In such a configuration, the one blower unit has an appearance configuration in which the first slope part and the second slope part extend from the first sidewall and the second sidewall, respectively, at both ends of the one blower unit to the one protruding part positioned between these sidewalls. Further, the other blower unit has an appearance configuration in which the third slope part and the fourth slope part extend from the third sidewall and the fourth sidewall, respectively, at both ends of the other blower unit to the other protruding part positioned between these sidewalls. Then, in the one blower unit, the one protruding part protrudes downward from the first slope part and the second slope part and the lower end surface of the one protruding part forms the lower end part of the one blower unit, and in the other blower unit, the other protruding part protrudes upward from the third slope part and the fourth slope part and the upper end surface of the other protruding part forms the upper end part of the other blower unit. Thus, in a case where the one blower unit and the other blower unit which have the one protruding part and the other protruding part, respectively, are vertically arranged, these protruding parts are bulky and there arises a possibility that the placement space for these blower units may become larger. In contrast to this, these blower units are arranged so that the lower end surface of the one protruding part in the one blower unit on the upper side protrudes to be lower than the upper end surface of the other protruding part in the other blower unit on the lower side. As a result, it becomes possible to compactly arrange these blower units.

The web drying apparatus may be configured so that the first slope part slopes at a certain first angle with respect to the horizontal direction, the second slope part slopes at a certain second angle with respect to the horizontal direction, the third slope part slopes at a certain third angle with respect to the horizontal direction, and the fourth slope part slopes at a certain fourth angle with respect to the horizontal direction. In such a configuration, the first to fourth slope parts can be formed of plates attached, being sloped at the first to fourth angles, respectively, and therefore, it is possible to simply configure the web drying apparatus.

The web drying apparatus may be configured so that the one blower unit has a plurality of one-side nozzles which are arranged in an extending direction of the upper dry path and each face, from downward, the web passing through the upper dry path and injects gas from each of the plurality of one-side nozzles, the gas being supplied to an inside of one chamber constituted of the first sidewall, the second sidewall, and the one protruding part, and the other blower unit has a plurality of the other-side nozzles which are arranged in an extending direction of the lower dry path and each face, from upward, the web passing through the lower dry path and injects gas from each of the plurality of the other-side nozzles, the gas being supplied to an inside of the other chamber constituted of the third sidewall, the fourth sidewall, and the other protruding part.

In such a configuration, the gas supplied to an inside of the one chamber constituted of the first sidewall, the second sidewall, and the one protruding part in the one blower unit from the outside is injected from each of the plurality of one-side nozzles. The first slope part and the second slope part which extend from one and the other ends of the one blower unit, respectively, to the one protruding part slope down toward the one protruding part to the horizontal direction, and a taper which tapers toward both ends is provided inside the one chamber. Therefore, the gas can be injected uniformly from the plurality of one-side nozzles while suppressing any effect of pressure loss. Further, the same effect is produced in the other blower unit.

The web drying apparatus may be configured so that the one blower unit has one opening which is opened in a direction orthogonal to the extending direction of the upper dry path and the vertical direction between a first imaginary straight line which coincides with one end of the one protruding part in the horizontal direction and is in parallel with the vertical direction and a second imaginary straight line which coincides with the other end of the one protruding part in the horizontal direction and is in parallel with the vertical direction, and the gas is supplied to an inside of the one chamber from the one opening, and the other blower unit has the other opening which is opened in a direction orthogonal to the extending direction of the lower dry path and the vertical direction between a third imaginary straight line which coincides with one end of the other protruding part in the horizontal direction and is in parallel with the vertical direction and a fourth imaginary straight line which coincides with the other end of the other protruding part in the horizontal direction and is in parallel with the vertical direction, and the gas is supplied to an inside of the other chamber from the other opening. In such a configuration, in the one blower unit, the gas is supplied from the one opening provided between the first slope part and the second slope part. Specifically, the gas can be supplied from a space between the tapers on both sides, which are provided inside the one chamber, and it is possible to uniformly inject the gas from the plurality of one-side nozzles. Further, the same effect is produced in the other blower unit.

The web drying apparatus may be configured so that the one opening at least partially overlaps the one protruding part, and the other opening at least partially overlaps the other protruding part. In such a configuration, since a distance between the one opening from which the gas is supplied and the one-side nozzles can be ensured in the vertical direction, it is possible to uniformly inject the gas from the plurality of one-side nozzles. Further, the same effect is produced in the other blower unit.

Although the invention has been described with reference to specific embodiments, this description is not meant to be construed in a limiting sense. Various modifications of the disclosed embodiment, as well as other embodiments of the present invention, will become apparent to persons skilled in the art upon reference to the description of the invention. It is therefore contemplated that the appended claims will cover any such modifications or embodiments as fall within the true scope of the invention.

What is claimed is:

1. A web drying apparatus, comprising:

two blower units which are arranged vertically between an upper dry path and a lower dry path disposed below the upper dry path and at least partially overlap each other when viewed from a vertical direction, wherein one blower unit disposed on an upper side, among the two blower units, faces the upper dry path from downward and injects gas onto a web passing through the upper dry path, the other blower unit disposed on a lower side, among the two blower units, faces the lower dry path from upward and injects gas onto a web passing through the lower dry path, the one blower unit has a first sidewall provided at one end in a horizontal direction, a second sidewall provided at the other end in the horizontal direction, and a lower end part which is disposed between the first sidewall and the second sidewall, the lower end part is positioned lower than the first sidewall and the second sidewall and forms a lower end of the one blower unit, the other blower unit has a third sidewall provided at one end in the horizontal direction, a fourth sidewall provided at the other end in the horizontal direction, and an upper end part which is disposed between the third sidewall and the fourth sidewall, the upper end part is positioned upper than the third sidewall and the fourth sidewall and forms an upper end of the other blower unit, and the lower end part of the one blower unit deviates from the upper end part of the other blower unit in the horizontal direction and protrudes to be lower than the upper end part in the vertical direction.

2. The web drying apparatus according to claim 1, wherein the one blower unit has one protruding part positioned between the first sidewall and the second sidewall, a first slope part extending from the first sidewall to the one protruding part and sloping down toward the one protruding part with respect to the horizontal direction, and a second slope part extending from the second sidewall to the one protruding part and sloping down toward the one protruding part with respect to the horizontal direction, and the one protruding part protrudes downward from the first slope part and the second slope part and a lower end surface of the one protruding part corresponds to the lower end part, and the other blower unit has the other protruding part positioned between the third sidewall and the fourth sidewall, a third slope part extending from the third sidewall to the other protruding part and sloping up toward the other protruding part with respect to the horizontal direction, and a fourth slope part extending from the fourth sidewall to the other protruding part and sloping up toward the other protruding part with respect to the horizontal direction, and the other protruding part protrudes upward from the third slope part and the fourth slope part and an upper end surface of the other protruding part corresponds to the upper end part.

3. The web drying apparatus according to claim 2, wherein the first slope part slopes at a certain first angle with respect to the horizontal direction, the second slope part slopes at a certain second angle with respect to the horizontal direction, the third slope part slopes at a certain third angle with respect to the horizontal direction, and the fourth slope part slopes at a certain fourth angle with respect to the horizontal direction.

4. The web drying apparatus according to claim 2, wherein the one blower unit has a plurality of one-side nozzles which are arranged in an extending direction of the upper dry path and each face, from downward, the web passing through the upper dry path and injects gas from each of the plurality of one-side nozzles, the gas being supplied to an inside of one chamber constituted of the first sidewall, the second sidewall, and the one protruding part, and the other blower unit has a plurality of the other-side nozzles which are arranged in an extending direction of the lower dry path and each face, from upward, the web passing through the lower dry path and injects gas from each of the plurality of the other-side nozzles, the gas being supplied to an inside of the other chamber constituted of the third sidewall, the fourth sidewall, and the other protruding part.

5. The web drying apparatus according to claim 4, wherein the one blower unit has one opening which is opened in a direction orthogonal to the extending direction of the upper dry path and the vertical direction between a first imaginary straight line which coincides with one end of the one protruding part in the horizontal direction and is in parallel with the vertical direction and a second imaginary straight line which coincides with the other end of the one protruding part in the horizontal direction and is in parallel with the vertical direction, and the gas is supplied to an inside of the one chamber from the one opening, and the other blower unit has the other opening which is opened in a direction orthogonal to the extending direction of the lower dry path and the vertical direction between a third imaginary straight line which coincides with one end of the other protruding part in the horizontal direction and is in parallel with the vertical direction and a fourth imaginary straight line which coincides with the other end of the other protruding part in the horizontal direction and is in parallel with the vertical direction, and the gas is supplied to an inside of the other chamber from the other opening.

6. The web drying apparatus according to claim 5, wherein the one opening at least partially overlaps the one protruding part, and the other opening at least partially overlaps the other protruding part.

* * * * *